US005206444A

United States Patent [19]

Oliver

[11] Patent Number: 5,206,444

[45] Date of Patent: Apr. 27, 1993

[54] DEVICE THAT DISPLAYS COUNT OF ROUNDS IN FIREARM MAGAZINES

[76] Inventor: Harry M. Oliver, 701 E. Harrison St., Dillon, S.C. 29536

[21] Appl. No.: 614,937

[22] Filed: Nov. 16, 1990

[51] Int. Cl.[5] ..... F41A 9/62

[52] U.S. Cl. ..... 42/1.02; 42/7

[58] Field of Search ..... 42/1.02, 7, 50

[56] References Cited

U.S. PATENT DOCUMENTS

| | | | |
|---|---|---|---|
| 954,904 | 4/1910 | White | 42/7 |
| 1,252,094 | 1/1918 | Delempdes | 42/1.02 |
| 2,828,568 | 4/1958 | Sakewitz | 42/1.02 |
| 3,039,366 | 6/1962 | Imthurn et al. | 42/7 |
| 3,758,978 | 9/1973 | Theodore | 42/1.02 |
| 4,109,401 | 8/1978 | Musgrave | 42/50 |
| 4,142,313 | 3/1979 | Musgrave | 42/50 |
| 4,216,601 | 8/1980 | Musgrave | 42/1.02 |
| 4,219,953 | 9/1980 | Musgrave | 42/1.02 |
| 4,587,756 | 5/1986 | Jakubaschk et al. | 42/1.02 |

FOREIGN PATENT DOCUMENTS

| | | | |
|---|---|---|---|
| 463244 | 2/1914 | France | 42/1.02 |
| 409519 | 7/1946 | Italy | 42/1.02 |

*Primary Examiner*—Charles T. Jordan

*Attorney, Agent, or Firm*—W. Alex Dallis, Jr.

[57] ABSTRACT

A display device for showing the exact number of rounds remaining in a firearm magazine without removing the magazine from the weapon. The device comprises a grip panel assembly attachable to the frame of an automatic pistol. The assembly includes a grip having a transparent window through which a numbered scale can be seen. The frame and magazine of the firearm are modified, if necessary, to include elongate slits through which a portion of the follower is visible. As the weapon is fired a highly visible marker, strategically placed on the exposed follower, points to succeeding numbers on the calibrated scale, indicating the number of rounds in the magazine at any given time while the magazine remains in the firearm. This method of counting rounds is adaptable to automatic rifles having exposed magazines.

7 Claims, 3 Drawing Sheets

DEVICE THAT DISPLAYS COUNT OF ROUNDS IN FIREARM MAGAZINES

BACKGROUND OF THE INVENTION

This invention relates generally to the art of counters which indicate number of rounds remaining in firearm magazines, and most particularly, to such counters showing an exact count of rounds in a magazine while the magazine remains in the firearm.

Various devices have been devised which include means for revealing the contents of a magazine. Several patents have been granted for devices which utilize either a colored mark on a follower or an audible alarm to indicate whether a magazine is full or empty.

U.S. Pat. No. 4,587,756 to Jakubaschk et al. discloses a magazine which includes a colored indicator to show the magazine is ready to fire. U.S. Pat. No. 4,109,401 to Musgrave describes a follower fashioned of radiant color to approximately count, according to its position, the number of cartridges in an opaque magazine which includes numbers thereon which correspond to each position of cartridges therein.

An audible signal for indication of an empty magazine is used in U.S. Pat. No. 4,142,313 to Musgrave wherein a noise is made when a magazine has been depleted of its contents. Similar audible indicators are disclosed in U.S. Pat. Nos. 4,216,601 to Musgrave and 4,219,953 also to Musgrave.

While these prior art devices perform well for their intended applications, there is no satisfactory device for counting rounds in a firearm magazine without removing the magazine from the weapon.

PUBLICATIONS

"A Question of Caliber," by Ken Hackathorn; *Guns & Ammo*; July 1990; p. 104.

SUMMARY OF THE INVENTION

It is therefore an object of this invention to provide a display device to show the exact count of rounds in a magazine without having to remove the magazine from the firearm.

It is a further object of this invention to provide a grip panel assembly attachable to the grip frame of a firearm incorporating the display device for the count of rounds.

It is a still further object of this invention to provide a grip panel assembly to show the exact number of rounds remaining in a magazine after a shot or shots have been fired without removing the magazine from the firearm.

These, as well as other objects, are accomplished by a display device for showing the exact number of rounds remaining in a firearm magazine without removing the magazine from the weapon. The device comprises a grip panel assembly attachable to the frame of an automatic pistol. The assembly includes a grip having a transparent window through which a numbered scale can be seen. The frame and magazine of the firearm are modified, if necessary, to include elongate slits through which a portion of the follower is visible. As the weapon is fired a highly visible marker, strategically placed on the exposed follower, points to succeeding numbers on the calibrated scale, indicating the number of rounds in the magazine at any given time while the magazine remains in the firearm. This method of counting rounds is adaptable to automatic rifles having exposed magazines.

In accordance with this invention it has been found that the ability to show a count of rounds in a magazine while the magazine remains in the firearm provides superior use characteristics. It has additionally been discovered that a grip panel assembly having a window through which a count of rounds can be viewed on a numbered scale provides essential information for troops, especially important in combat situations. It has further been discovered that a manufacturer can easily modify existing frames and magazines, if necessary, to accommodate the assembly. It has further been found that this method of counting rounds is adaptable to automatic rifles having exposed magazines.

DETAILED DESCRIPTION

While the specification concludes with claims particularly pointing out and distinctly claiming the subject matter which is regarded as the invention—in light of the doctrine of equivalence, it is believed that the invention, the objects, features, and advantages thereof, will be better understood from the following description taken in connection with the accompanying drawings.

Figure 1:
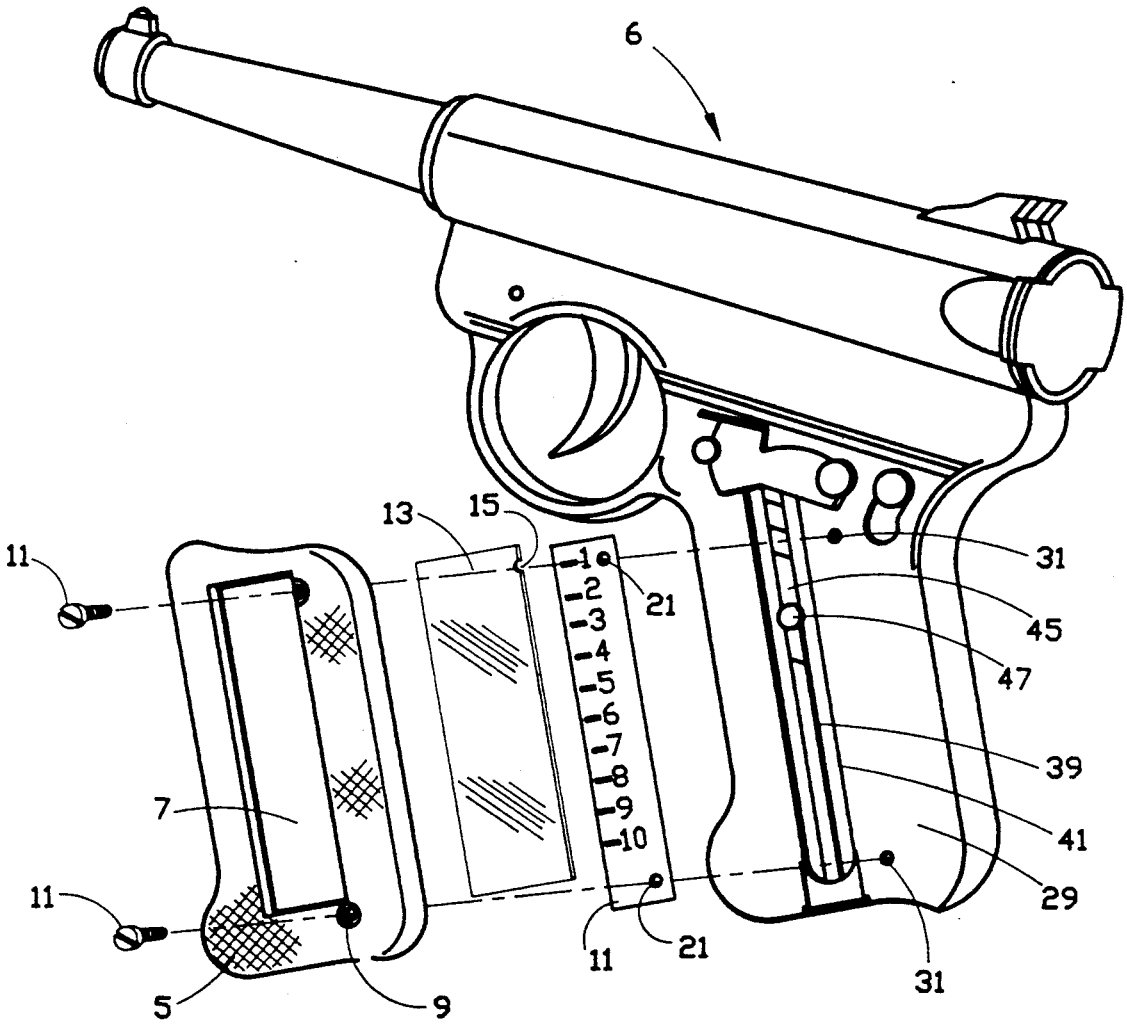
FIG. 1 of the drawings illustrates a grip panel assembly in accordance with this invention.

FIG. 1 of the drawings illustrates a grip panel assembly in accordance with this invention comprising a grip panel 5, a window 13, and a scale 17. The assembly shown here is adapted for use with a Mark 2 Ruger .22 calibre pistol 6, but it is understood that this assembly can be adapted, without departing from the spirit of the design thereof, to fit any automatic pistol or rifle. And the modifications need not be substantial, as will be described.

The grip 5 in accordance with this invention may be constructed of any wood, plastic, or similar material heretofore utilized provided a secure, texturized gripping surface is achieved. A vertical elongated aperture 7 is centrally located on grip panel 5 and surrounds window 13 fabricated of a transparent, shatterproof plastic or similar material. Window 13 fits snugly into aperture 7 and is glued therein, or both components can be manufactured as one piece. Scale 17 comprises a non-corrosive, grease-resistant, metal, plastic or the like and includes a set of numbers 19 corresponding to each of rounds 23 in magazine 25.

Each piece of this assembly includes two eyelets, with the exception of window 13 which has only one eyelet 15. Grip panel 5 includes eyelets 9 and scale 17 includes eyelets 21. When aligned, screws 11 pass therethrough.

In order to receive the assembly, the portion of an automatic pistol on which the assembly is to be attached must first be modified as described hereinafter. These changes can be easily and inexpensively performed by a manufacturer on nearly all firearms. The Ruger 6 shown here has been modified wherein grip frame 29 includes two eyelets 31, both of which are threaded to receive screws 11. The assembly is easily attached to grip frame 29 by simply inserting screws 11 through eyelets 9, 15, and 21 and then into eyelets 31.

A manufacturer may also need to alter the construction of a magazine to communicate with the assembly. Specifically, the casing of a magazine must include a longitudinal aperture exposing the follower therein, and a marker must be particularly placed on the follower. Some magazines already have such an aperture exposing the follower, therefore absolving need to make modifications except for placing a mark on the follower. As illustrated in FIG. 1, the left side of magazine 25 has an elongate vertical slot 39 centrally made of sufficient length and width to make visible a portion of follower 45 and marker 47. The number of rounds 23 remaining in magazine 25 can be identified by the position of marker 47 as it corresponds to numbers 19 on scale 17. Distance between each number is determined by the calibre of rounds 23. For example, numbers 19 will be spaced at a larger interval for .38 calibre than for .22 calibre simply because of the difference in bullet dimension. Marker 47 will disappear by moving upwardly and out of the perimeter of window 17 when rounds 23 are depleted.

It is important to note that marker 47 should be strategically located on a follower to allow an accurate count of remaining rounds. The follower should be of a distinctive dimension such that the mark thereon can indicate, on the scale, the number of rounds left in a magazine. For example, shown here in FIG. 1 is follower 45 of sufficient length to allow marker 47 to indicate "1" on scale 17 when only one of rounds 23 is left in magazine 25. That is, follower 45 is of sufficient length to allow marker 47 to indicate that only one round is left since, nearing ammunition depletion, the upper portion of follower 45 will travel to the uppermost portion of grip frame 29 and therefore out of view. Rounds 23 are loaded into the chamber by means heretofore utilized, i.e., follower 45 is urged upwardly by a follower spring attached to the bottom portion of magazine 25.

Now, in order to allow marker 47 to be visible on scale 17, an aperture is made on the grip frame of a firearm if such an aperture does not already exist. The Ruger 6 shown here already has a sufficient slit 41 of slightly greater dimension than slot 39 and disposed exactly thereover allowing follower 45 and, most importantly, marker 47 to be visible.

Figure 2:
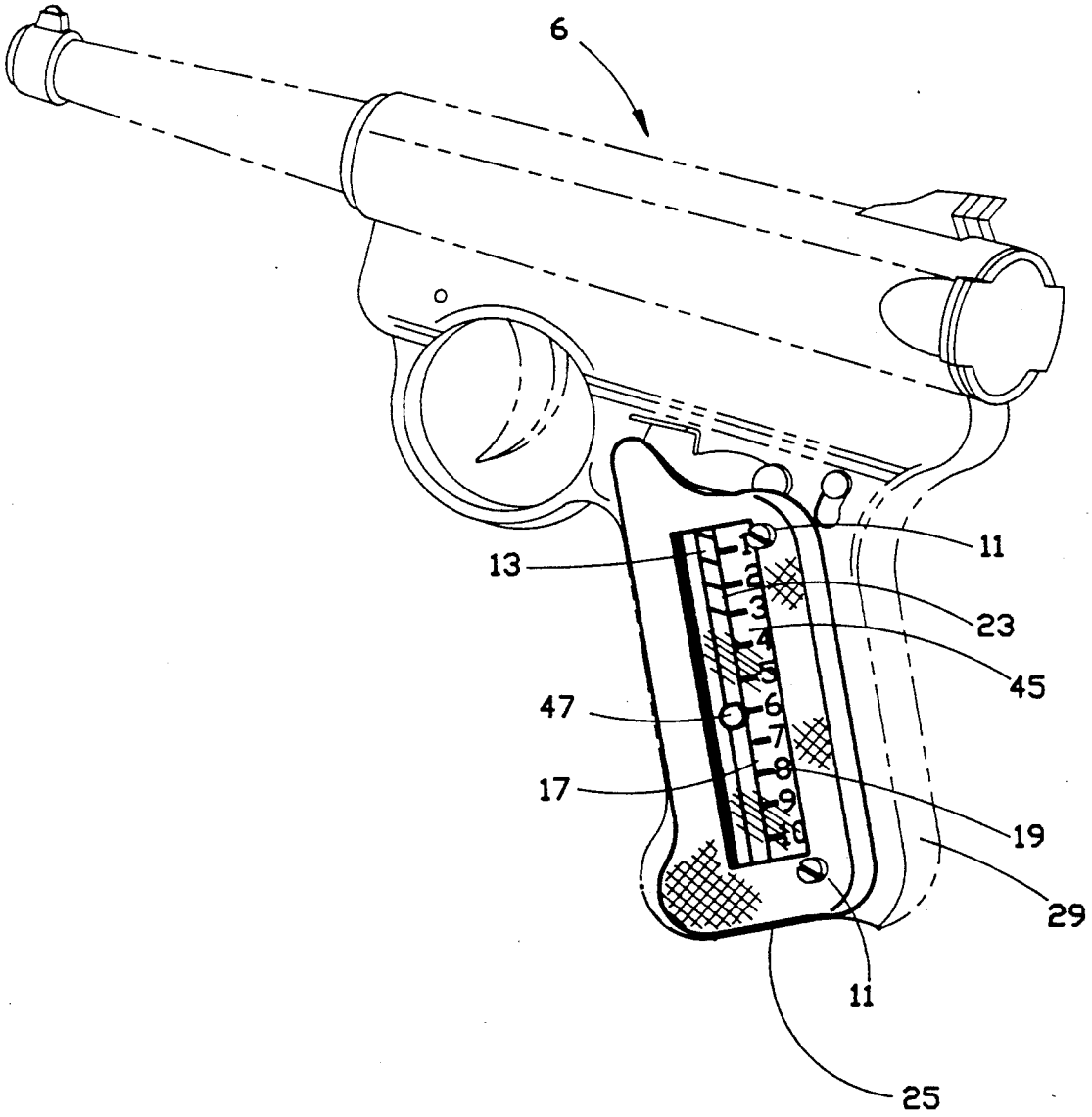
FIG. 2 of the drawings illustrates a grip panel assembly attached to a Mark 2 Ruger .22 calibre pistol.
Figure 3:
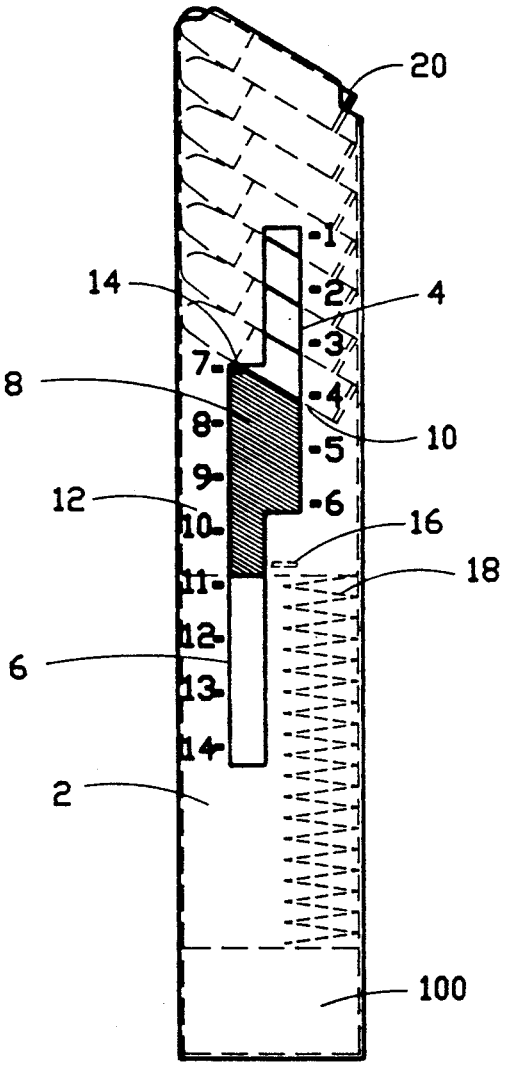
FIG. 3 and 4 illustrate modified high-capacity magazines.

FIG. 2 of the drawings illustrates the assembly secured to left grip panel 29 of Ruger 6. As shown, scale 17, adjacently parallel to follower 45, is readily visible through window 13 which provides a seal from the elements. Numbers 19 and marker 47 can comprise a highly visible paint. It is beneficial to use a glare-free plastic for window 13, or perhaps a roughened plastic material to prevent glare from the sun so troop positions may not be revealed. As each round is fired from Ruger 6, follower 45 urges the next round 23 upwardly. Concurrently, marker 47 moves upwardly and denotes remaining number of rounds 23 in magazine 25.

Figure 4:
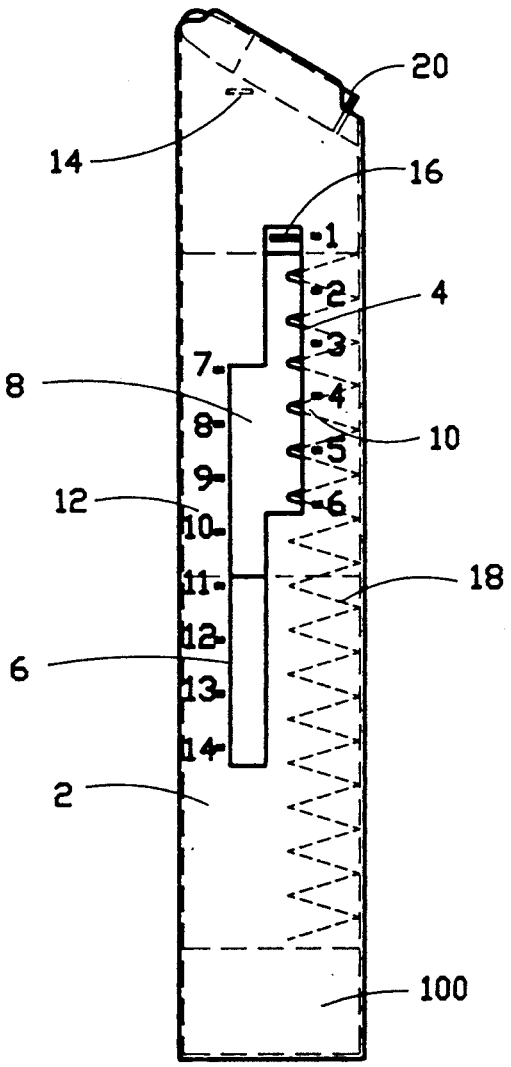

Some high-capacity, or double-column, magazines may need to be modified to accommodate the assembly. If an automatic pistol or rifle uses a high-capacity magazine, the following changes should be made in the design thereof so an exact count of rounds can be shown. FIGS. 4 and 5 of the drawings illustrate a high-capacity magazine in accordance with this invention. The magazine shown here includes a plate 2 having a first and second adjacently parallel vertical slits 4 and 6, respectively. A follower 8 is located inside the magazine, and a follower spring 18 is also located therein, as heretofore utilized.

Attached to plate 2 is a transparent scale 100 which includes a group of numbers imprinted thereon which corresponds to the positions of rounds 20. A first set 10 comprise an increasing value of numbers adjacently parallel to first slit 4 and include, but not are not limited to, "1,2,3,4,5,6." Adjacently parallel to second slit 6 is a second set 12 including, but not limited to, "7,8,9,10,11,12,13,14." Both sets of numbers may be formed of highly visible paint. First set of numbers 10 may be of different color to signal impending exhaustion of rounds 20.

Follower 8, urged upwardly by follower spring 18, includes a top marking 14 and bottom marking 16 on its generally quadrangular shape. Top marking 14 is disposed to the left of bottom marking 16 and is visible only in slit 6. Conversely, bottom marking 16 is positioned to be visible only in slit 4. Therefore, these markings are never concurrently visible due to the staggered design of slits 4 and 6. Bottom marking 16 will denote any of last six of rounds 20 remaining in the magazine, and top marking 14, as illustrated, will show count of any of rounds "7,8,9,10,11,12,13,14." The vertical distance between "6" and "7" is the same as the vertical distance between top marking 14 and bottom marking 16 on follower 8. This arrangement allows all rounds in the magazine to be counted. When rounds 20 are depleted, bottom marking 16 will disappear from view as follower 8 moves into the upper portion of the magazine. The action of moving rounds 20 into the loading chamber is accomplished by such action heretofore utilized, i.e., follower spring 18 pushes follower 8 upwardly which, in turn, urges rounds 20 into a loading chamber.

Top marking 14 and bottom marking 16 can be viewed from a grip panel assembly in accordance with this invention when the high-capacity, or double-column, magazine is used in an automatic pistol. The staggered design of slits 4 and 6, as well as the dimension of the follower 8, allow counting of all rounds in high-capacity magazines. It is noted that slits 4 and 6 may be made in plate 2 as two untouching parallel slots allowing additional strength to the magazine. In any case, slits 4 and 6 define a generally Z-shape. Spacing between each number, of course, depends on the calibre of bullets in the magazine due to the differences in dimension. It is also noted that transparent scale 100, instead of being attached to the high-capacity magazine, may be attached to the grip frame of a automatic pistol and thus viewed through a grip panel assembly as illustrated in FIGS. 1 and 2.

For counting rounds in magazines for automatic rifles having exposed magazines, the modified high-capacity magazine described above can be used in place of the existing magazine.

As various modifications become apparent to those familiar with the art, such modifications may be practiced without departing in any way from the spirit of the following appended claims.

That which is claimed is:

1. A display device which shows the exact count of rounds in a firearm magazine having a follower, said device comprising:

a. a grip panel assembly which further comprises:

i. a grip providing a textured gripping surface, there being defined in said grip an elongate aperture centrally positioned therethrough;

ii. a window formed of transparent shatterproof material, said window surrounded by said grip;

b. means for displaying on a scale visible through said window the number of rounds in said magazine, which means comprises:

i. a plate, attached to the outside of the magazine, having defined therein two vertical slits centrally positioned thereon, the top of the first such slit extending upward beyond the top of the second such slit, the top of said second slit being adjacent to the mid-section of said first slit, the bottom of said first slit being adjacent to the mid-section of said second slit and the bottom of said second slit extending downward beyond the bottom of said first slit, said slits forming a generally Z-shape; and ii. a scale attached to said plate, said scale including a group of numbers adjacently positioned to said slits wherein said first slit includes a first set of numbers in increasing value such as, but not limited to, "1,2,3,4,5,6," and said second slit includes a second set of numbers in increasing value such as, but not limited to, "7,8,9,10,11,12,13,14," said numbers vertically imprinted on said scale, alongside said slits, and corresponding and indicating the positions of said rounds inside said magazine;

iii. a mark on the top left section of the follower such that said mark is visible only through said second slit; and iv. a mark on the bottom right section of the follower such that said mark is visible only through said first slit.

2. A display device as recited in claim 1 wherein the scale is formed of a non-corrosive, grease-resistant material.

3. A display device as recited in claim 1 wherein there is defined in said window one eyelet and said window is snugly engaged in the elongate aperture defined in said grip.

4. A display device as recited in claim 1 wherein said window is formed of a translucent plastic material, the surface of which is roughened to eliminate glare.

5. A display device as recited in claim 1 wherein the numbers appearing upon said scale are positioned such that the mark on the follower which is visible lies adjacent to the number on said scale which is equal to the number of rounds in said magazine.

6. A display device as recited in claim 1 wherein said numbers are painted with a highly visible paint.

7. A display device as recited in claim 1 wherein said window and the grip are manufactured as a single piece.

* * * * *